US007669638B2

(12) United States Patent
Kollberg et al.

(10) Patent No.: US 7,669,638 B2
(45) Date of Patent: Mar. 2, 2010

(54) CONTROL SYSTEM, COMPUTER PROGRAM PRODUCT, DEVICE AND METHOD

(75) Inventors: Sten Kollberg, Västerås (SE); Jan-Erik Eriksson, Västerås (SE); Carl-Fredrik Lindberg, Västerås (SE); Mats Molander, Västerås (SE); Peter Löfgren, Västerås (SE); Göte Tallbäck, Västerås (SE); Rebei Bel Fdhila, Västerås (SE); Bertil Samuelsson, Västerås (SE); Stefan Israelsson Tampe, Västerås (SE); Christina Wallin, Västerås (SE)

(73) Assignee: ABB AB, Västeråa (SE)

( * ) Notice: Subject to any disclaimer, the term of this patent is extended or adjusted under 35 U.S.C. 154(b) by 0 days.

(21) Appl. No.: 10/536,424

(22) PCT Filed: Nov. 28, 2003

(86) PCT No.: PCT/SE03/01857

§ 371 (c)(1),
(2), (4) Date: Oct. 5, 2005

(87) PCT Pub. No.: WO2004/050277

PCT Pub. Date: Jun. 17, 2004

(65) Prior Publication Data

US 2006/0162895 A1 Jul. 27, 2006

Related U.S. Application Data

(60) Provisional application No. 60/429,884, filed on Nov. 29, 2002.

(30) Foreign Application Priority Data

Apr. 7, 2003 (SE) ..... 0301049

(51) Int. Cl.
*B22D 11/16* (2006.01)
*B22D 27/02* (2006.01)

(52) U.S. Cl. ..... 164/154.5; 164/502; 164/504; 164/452

(58) Field of Classification Search ..... 164/452, 164/453, 151.2, 151.3, 154.2, 154.3, 154.4, 164/154.5, 155.2, 155.4, 466, 468, 502, 504
See application file for complete search history.

(56) References Cited

U.S. PATENT DOCUMENTS 5,307,863 A * 5/1994 Kubota et al. ..... 164/466

(Continued)

FOREIGN PATENT DOCUMENTS

EP 0550785 A1 7/1993

(Continued)

OTHER PUBLICATIONS

Translation of Japanese Office Action - Apr. 28, 2009.

*Primary Examiner*—Kevin P Kerns
(74) *Attorney, Agent, or Firm*—Venable LLP; Eric J. Franklin

(57) ABSTRACT

A control system for regulating the flow of liquid metal in a device for casting a metal. A detector measures a process variable. A control unit evaluates data from the detector. At least one process parameter is automatically varied in order to optimize casting conditions. The detector measures a characteristic of the meniscus at at least two points on the meniscus instantaneously throughout the casting process.

25 Claims, 4 Drawing Sheets

U.S. PATENT DOCUMENTS

| | | | | |
|---|---|---|---|---|
| 5,605,188 | A * | 2/1997 | Banny et al. | 164/453 |
| 5,657,816 | A | 8/1997 | Harada et al. | |
| 6,494,249 | B1 | 12/2002 | Kollberg et al. | |

FOREIGN PATENT DOCUMENTS

| | | | |
|---|---|---|---|
| EP | 0707909 | A1 | 4/1996 |
| JP | 04-284956 | A | 10/1992 |
| JP | 05-237619 | A | 9/1993 |
| JP | 04-262841 | A | 9/1999 |
| JP | 2000-321115 | A | 11/2000 |
| WO | WO-95/26243 | A1 | 10/1995 |
| WO | WO 9911403 | A1 | 3/1999 |
| WO | WO 03041893 | A1 | 5/2003 |

* cited by examiner

CONTROL SYSTEM, COMPUTER PROGRAM PRODUCT, DEVICE AND METHOD

The present invention claims priority from U.S. provisional patent application 60/429,884, filed 29 Nov. 2002 and Swedish patent application 0301049-3 filed 7 Apr. 2003 and is the national phase under 35 U.S.C. § 371 of PCT/SE2003/001857.

TECHNICAL FIELD

The present invention relates to a control system for regulating the flow of liquid metal in a device for casting a metal. The control system comprises detection means to measure a process variable, a control unit to evaluate the data from the detection means and means to automatically vary at least one process parameter such as the casting speed, noble gas flow rate, magnetic field strength of electromagnetic means, such as an electromagnetic brake or stirring apparatus, slab width, or immersion depth of a submerged entry nozzle in order to optimize the casting conditions. The present invention also concerns a computer program product, a device and method for casting a metal.

BACKGROUND OF THE INVENTION

In the continuous casting process molten metal is poured from a ladle into a reservoir (tundish) at the top of the casting device. It then passes through a submerged or a free tapping nozzle at a controlled rate into a water-cooled mould where the outer shell of the metal becomes solidified, producing a metal strand with a solid outer shell and a liquid core. Once the shell has a sufficient thickness the partially solidified strand is drawn down into a series of rolls and water sprays to further extract heat from the strand surface, which ensures that the strand is both rolled into shape and fully solidified at the same time. As the strand is withdrawn (at the casting speed) liquid metal pours into the mould to replenish the withdrawn metal at an equal rate.

Once the strand is fully solidified it is straightened and cut to the required length for example into slabs (long, thick, flat pieces of metal with a rectangular cross section), blooms (a long piece of metal with a square cross section) or billets (similar to blooms but with a smaller cross section) depending on the design of the continuous casting device.

Slag is used to remove impurities from the metal, to protect the metal from atmospheric oxidation and to thermally insulate the metal. The slag also provides lubrication between the mould walls and the solidified shell. The mould is usually also oscillated to minimize friction and sticking of the solidifying shell to the mould walls and to avoid shell tearing.

Inside the mould the flow circulates within the sides of the walls of solidifying metal. When a submerged entry nozzle is used a primary flow is generated that flows downwards in the casting direction as well as a secondary flow that flows upwards along the walls of the mould towards the meniscus i.e. the surface layer of the liquid metal in the mould.

The molten metal entering the mould carries impurities such as oxides of aluminum, calcium and iron so a noble gas such as argon is usually injected into the nozzle to prevent it from clogging with such deposits. These impurities can either float to the top of the mould in the secondary flow where they become entrained harmlessly onto the slag layer at the meniscus, often after circulating within the mould, or they can be carried down into the lower parts of the mould in the primary flow and become trapped in the solidifying front leading to defects in the cast metal products.

The metal flow into the mould must be controlled to enhance the flotation of the impurities and to prevent turbulence from drawing impurities back down into the mould where they can be incorporated into the cast products. This is usually done by applying one or more magnetic fields to act on the liquid metal entering the mould as well as on the liquid metal inside the mould. An electromagnetic brake (EMBR) can be used to slow down the liquid metal entering the mould to prevent the molten metal from penetrating deep into the cast strand. This prevents non-metallic particles and/or gas being drawn into and entrapped in the solidified strand and also prevents hot metal from disturbing the thermal and mass transport conditions during solidification causing the solidified skin to melt.

Electromagnetic stirring means can also be used to ensure a sufficient heat transport to the meniscus to avoid freezing as well as to control the flow velocity at the meniscus so that the removal of gas bubbles and inclusions from the melt is not put at risk.

If the metal flow velocity at the surface of the meniscus is too great it may shear off some of the slag layer and thereby form another source of harmful inclusions if they become entrapped in the cast products. However if the surface flow is too slow the mould powder at the meniscus may cool to a too low temperature and solidify thus decreasing its effectiveness.

Periodic velocity variations of the metal flow in the mould occur due to the oscillation of the mould, changes in the flow rate of liquid metal leaving the nozzle and variations of the casting speed. These velocity variations give rise to pressure and height variations at the meniscus which can result in slag being drawn into the lower part of the mould, an uneven slag thickness and a risk of crack formation. The velocity of the flow at the meniscus is therefore critical for both removal of impurities and trapping of slag powder and thereby related to the quality of the cast products. EP 0707909 discloses that the flow velocity at the meniscus, $v_m$, should be maintained within the range of 0.2-0.4 $ms^{-1}$ for a continuous casting process. However $v_m$ is difficult to measure directly.

U.S. Pat. No. 6,494,249 discloses a method for continuous or semi-continuous casting of a metal wherein the secondary flow velocity is monitored so that upon detection of a change in the secondary flow, information on the detected change is fed to a control unit where the change is evaluated and the magnetic flux density of the electromagnetic brake of a casting device is regulated to maintain or adjust the flow velocity. This method is based on the assumption that the flow at the meniscus, $v_m$, is a function of the upwardly directed secondary flow.

U.S. Pat. No. 6,494,249 describes that the upwardly directed secondary flow velocity at one of the mould's sides can be monitored by monitoring the height, location and/or shape of a standing wave, that is generated on the meniscus by the upwardly directed secondary flow at one of the mould's sides. Upon detection of a change, the change is evaluated and the magnetic flux density is regulated based on this evaluation.

A disadvantage with this method is that the standing wave has to be monitored over a period of time in order to detect a change before information indicating that a change has occurred can be fed to the control unit. Oscillation of the mould during the monitoring period can affect the height, shape and location of the standing wave and thus adversely affect the accuracy of the monitoring.

Furthermore, U.S. Pat. No. 6,494,249 describes the use of electromagnetic induction sensors to monitor the standing wave. Electromagnetic induction sensors operate by detecting changes in sensor coil impedance (active or reactive), which varies as a result of changing distance between the sensor coil and the surface of a conductive material. A coil driven by a time-varying current generates a magnetic field around the sensor coil. When a ferromagnetic material is introduced into this field the coil's inductive reactance is usually increased due to the high permeability of the ferromagnetic material. A problem with using sensors that are based on electromagnetic induction is that they can experience interference from electromagnetic means such as the EMBR or stirring apparatus that are usually used in casting devices, which affects the accuracy of such sensors.

SUMMARY OF THE INVENTION

It is an object of this invention to provide on-line regulation of process parameters during a metal casting process to control and optimize casting conditions and consequently provide a cast product with a minimum of defects at the same or improved productivity.

The control system comprises detection means such as inductive, optic, radioactive or thermal sensors to measure a process variable, a control unit to evaluate the data from the detection means and means to automatically vary at least one process parameter such as the casting speed, noble gas flow rate, or magnetic field strength of electromagnetic means, such as an EMBR or stirring apparatus, slab width, immersion depth of a submerged entry nozzle, or an angle of the submerged entry nozzle, in order to optimize the casting conditions.

According to a preferred embodiment of the invention the characteristic of the meniscus that is measured is the height of the meniscus and the height difference between two points or an average in time or space is analyzed and used to infer the flow velocity of molten metal at the meniscus ($v_m$). The dynamic pressure produced by the upwardly moving secondary flow lifts the meniscus level locally and so by measuring the height difference between the lifted region and the surrounding level an indirect $v_m$ measurement is made. Experiments have shown that $v_m$ values inferred in this way can be used to regulate the flow of liquid metal in a casting device instead of difficult to obtain $v_m$ measurements.

Once $v_m$ has been inferred at least one process parameter is varied in order to maintain $v_m$ within a predetermined range or at a predetermined value in the range 0.1-0.5 $ms^{-1}$, preferably in the range 0.2-0.4 $ms^{-1}$. The control system actively regulates at least one process parameter to maintain the meniscus characteristic or $v_m$ within an optimum range and in this way provides conditions that minimize the emergence of blisters (formed by entrapped gas bubbles) and inclusions in the cast products.

According to another preferred embodiment of the invention the characteristic of the meniscus that is measured is the temperature, which is measured directly, or indirectly by measuring the temperature of the mould wall for example. The meniscus temperature is controlled to avoid surface defects and a high and uniform temperature at the meniscus is optimal for this. Measuring the temperature at two points on the meniscus also provides an indirect way of measuring $v_m$ i.e. $v_m$ is inferred from the temperature measurements.

According to a preferred embodiment of the invention a characteristic of the meniscus is measured in a first region where the upwardly flowing metal of the secondary flow makes impact with the meniscus and in a second region downstream to the first region. The first and second regions are usually situated on the same side of the submerged entry nozzle, i.e. between the submerged entry nozzle and a mould wall.

The control system of the present invention comprises detection means that sample data either continuously or periodically. The detection means are devices based on electromagnetic induction, including variable impedance, variable reluctance, inductive and eddy current sensors, optic, radioactive or thermal devices such as a thermocouple that measure thermal flux.

According to a preferred embodiment of the invention, at least one of the detection means is arranged movable across and essentially parallel to the meniscus.

According to a preferred embodiment of the invention, when induction sensors are used together with electromagnetic means, such as an EMBR or electromagnetic stirring apparatus, the electromagnetic means are temporarily deactivated while the induction sensors sample data. Process variables such as $v_m$ often change relatively slowly so that if an EMBR is disconnected, it takes at least a few seconds before $v_m$ changes considerably. Sensors usually make measurements within less than a second so as long as the period of disconnection is short, then $v_m$ will not vary considerably during this period.

The EMBR's magnetic field does not decay entirely when the EMBR is deactivated; a magnetic induction, i.e. remanence, remains. If, however, the EMBR is disconnected at a predetermined phase position of the sensor, the amount of remanence may be calculated and taken into account to correct the measurements made by the sensor. In a preferred embodiment of the invention the electromagnetic means are therefore deactivated at a predetermined phase position of the detection means so that the remaining remanence may be corrected for.

Alternatively, at least one current pulse is provided by the electromagnetic means during their de-activation period in order to remove the remanence remaining after their de-activation, which further reduces the amount of error in the measurements.

In casting devices in which the mould is oscillated several process variables including the meniscus level are influenced by such oscillation, which interferes with measurements taken. In a further embodiment of the invention, in order to minimize the oscillation's interference with measurements made by the detection means, the measurements are taken in synchronization with the oscillation of the mould so as to ensure that measurements are always made at the same phase position of the mould oscillation. Alternatively filtering or time-averaging of the signals from the sensors are utilized.

In another preferred embodiment of the invention the detection means are incorporated into the electromagnetic means in order to ensure that measurements are made as close as possible to the area in which the electromagnetic means influence the process variable being measured. According to a still further preferred embodiment of the invention the detection means and the electromagnetic means utilize the same, or parts of the same, magnetic core and/or the same induction winding.

According to another preferred embodiment of the invention, the mould is split into two or more control zones and a characteristic of the meniscus is measured in each control zone. The mould is preferably split at a vertical line in the center of the mould and one of the process parameters is varied in order to achieve an essentially symmetrical flow in the mould. For a rectangular mould comprising two long side walls and two short side walls, the sensors are preferably arranged between the submerged entry nozzle and a short side of the mould. In order to achieve a symmetrical flow, a distance, extending between at least one short side of the casting mould and the submerged entry nozzle, is varied. The distance is varied by moving the submerged entry nozzle in a direction substantially parallel to the wide side of the mould or by moving at least one of the short sides of the mould.

When the mould is split into two or more control zones, the electromagnetic means may be divided into a number of parts corresponding to the number of control zones in the mould. When an unsymmetrical characteristic of the meniscus for the control zones is detected, the magnetic field from at least one part is varied in order to influence the flow in its corresponding control zone and to achieve a symmetrical flow in the mould.

According to another preferred embodiment of the invention the control system comprises software means to derive $v_m$ using data from the detection means and to determine the amount of regulation of a process parameter that is required to bring $v_m$ into the desired range or to the desired value in the event of a detected departure from the optimum range or value.

According to yet another preferred embodiment of the invention the control unit comprises a neural network.

The present invention also concerns a computer program product, for use in the control system of a device for casting a metal, which comprises computer program code means to evaluate the data from detection means measuring a characteristic of the meniscus in the mould of a casting device at at least two points on the meniscus instantaneously throughout the casting process. The computer program product need not necessarily be installed at the same location as the casting device. It may communicate with the control system of said device from a remote location via a network such as the Internet.

The present invention further concerns a device for casting a metal comprising a mould, means to supply liquid metal to the mould and electromagnetic means, such as an electromagnetic brake or stirring apparatus to regulate the flow of liquid metal in the mould. The device comprises a control system as described in any of the above embodiments to control the magnetic field strength of the electromagnetic means.

The present invention also relates to a method for casting a metal in which liquid metal is supplied to a mould and electromagnetic means, such as an electromagnetic brake or stirring apparatus, are used to regulate the flow of liquid metal in the mould. The method comprises measuring a characteristic of the meniscus such as the meniscus height or temperature at at least two points on the meniscus instantaneously using detection means, evaluating the data from the detection means and automatically varying at least one process parameter, such as casting speed, noble gas flow rate, or magnetic field strength of the electromagnetic means so as to achieve the desired product quality. On evaluation of the measured process variable at least one process parameter such as the casting speed, noble gas flow rate, magnetic field strength of electromagnetic means, such as an electromagnetic brake or stirring apparatus, slab width, immersion depth of a submerged entry nozzle, or an angle of the submerged entry nozzle is varied so as to maintain the process variable within a predetermined range or at a predetermined value.

The control system, computer program product, device and method are suitable for use particularly but not exclusively in the continuous or semi-continuous casting of a metal such as steel, aluminum or copper.

BRIEF DESCRIPTION OF THE DRAWING

The invention will now be described by way of example and with reference to the accompanying drawing in which.

DESCRIPTION OF THE PREFERRED EMBODIMENTS

Figure 1:
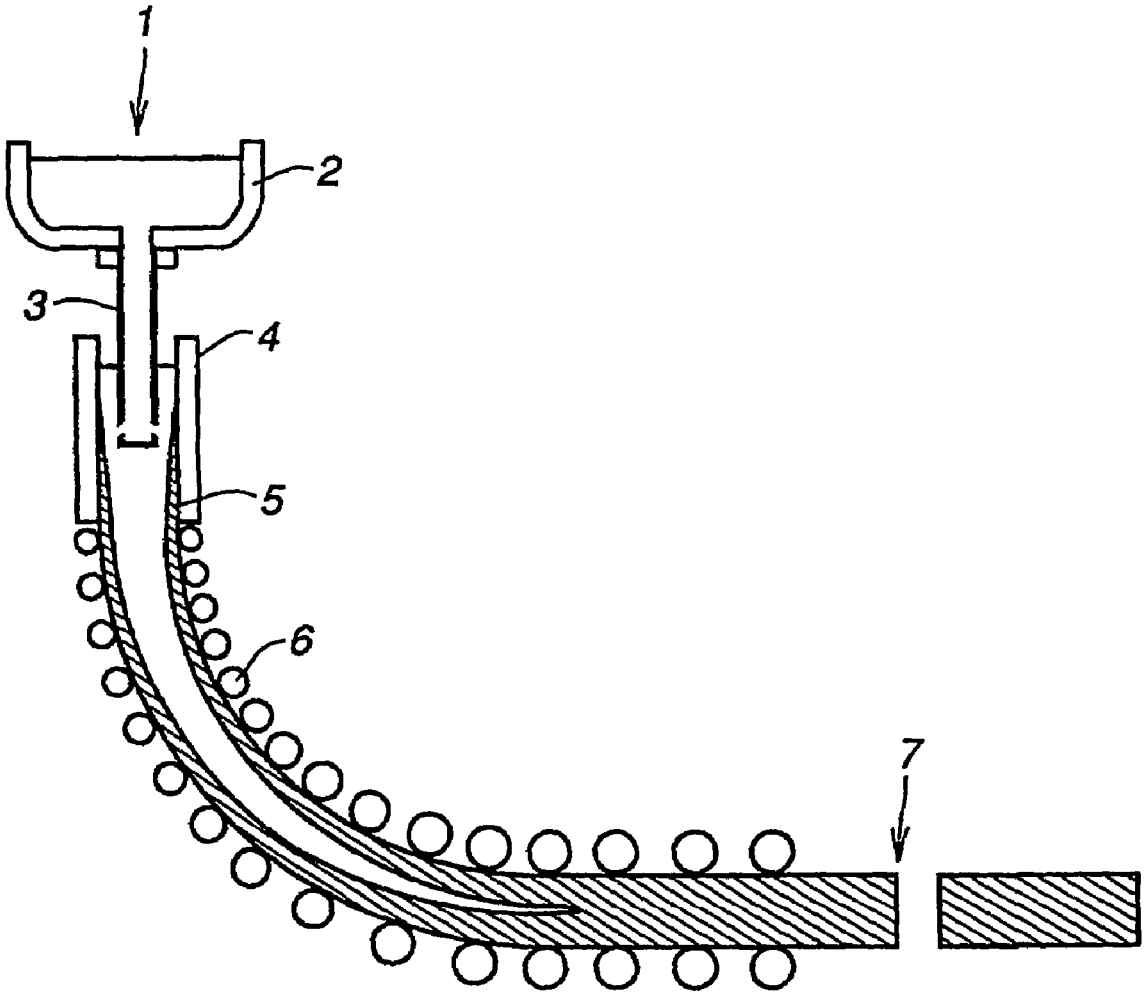
FIG. 1 shows a schematic diagram of a device for continuous casting of a metal.

In the continuous casting device shown in FIG. 1 molten metal 1 is poured from a ladle (not shown) into a tundish 2. It then passes through a submerged entry nozzle 3 into a water-cooled mould 4 where the outer shell of the metal becomes solidified, producing a metal strand with a solid outer shell 5 and a liquid core. Once the shell has a sufficient thickness the partially solidified strand is drawn down into a series of rolls 6 where the strand becomes rolled into shape and fully solidified. Once the strand is fully solidified it is straightened and cut to the required length at the cut off point 7.

Figure 2:
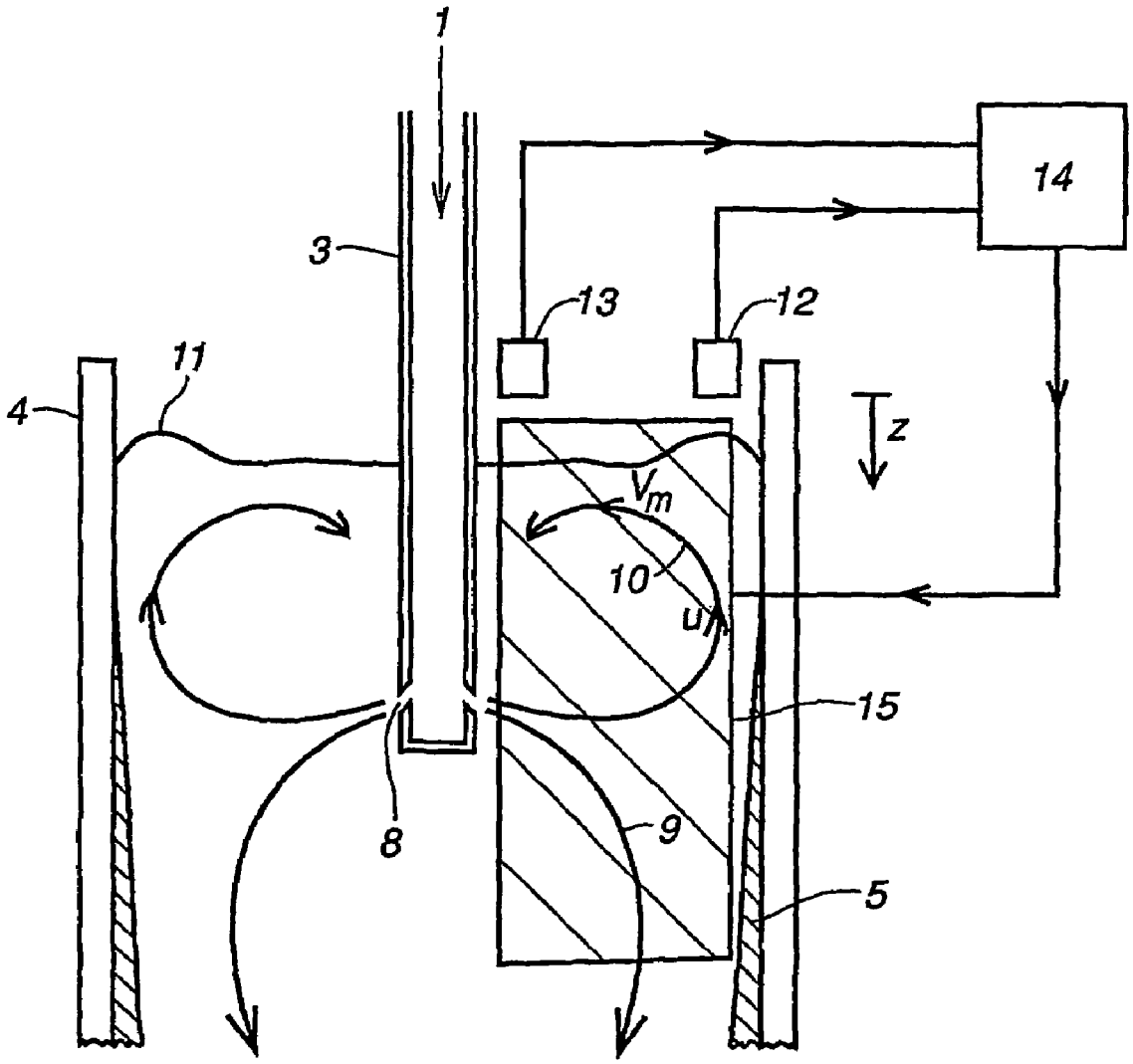
FIG. 2 shows an enlarged view of part of the casting device of FIG. 1 depicting a control system according to a preferred embodiment of the invention.

FIG. 2 shows the flow pattern of molten metal 1 entering a mould 4 via side ports 8 in a submerged entry nozzle 3. Inside the mould the flow circulates within the sides of the walls of solidifying metal 5. A primary flow 9 flows downwards in the casting direction. A secondary flow 10 flows upwards along the sides of the mould with a velocity u towards the meniscus 11. The kinetic energy of the upwardly moving secondary flow determines the magnitude of $v_m$. An EMBR is arranged to decelerate the secondary metal flow 10 in the upper part of the mould when necessary.

A control system for regulating the flow of liquid metal in the upper right-hand side of the mould is shown. The control system comprises two sensors 12, 13 such as lasers that measure the distance between the sensor and the meniscus, z, or the meniscus temperature at two locations and communicate this information to a control unit 14 via an electric, optic or radio signal. The sensors are located in a first region where the upwardly flowing metal of the secondary flow with velocity u, makes impact with the meniscus 11 (sensor 12) and in a second region downstream to the first, for example in the center of the mould 4 where the meniscus height is largely unaffected by the upwardly flowing metal of the secondary flow and is consequently relatively stable (sensor 13).

The control unit 14 evaluates the data from the sensors and sends at least one signal to a current limiting device which controls the amperage fed to the windings of the electromagnets in the EMBR or to mechanical means that adjust the distance between the magnetic core of the EMBR and the mould, for example, thereby varying the magnetic field strength of the EMBR which acts in at least part of the region 15.

The sensors, 12 and 13, measure the height of the meniscus at two locations. The height difference between these two locations is calculated and $v_m$ is derived from this calculation. The magnetic field provided by the EMBR is then manipulated in order to achieve a $v_m$ of 0.1-0.5 $ms^{-1}$. In addition to regulating the EMBR the flow rate of noble gas into the mould and the casting speed are also regulated to keep these parameters at the optimum value for each magnetic field strength. By pre-programming the control system with data on parameters that are likely to change during the casting process as a function of time or other parameter, the control system may be used to compensate for transient phenomena such as a change of ladle or erosion of the entry nozzle.

Figure 3:
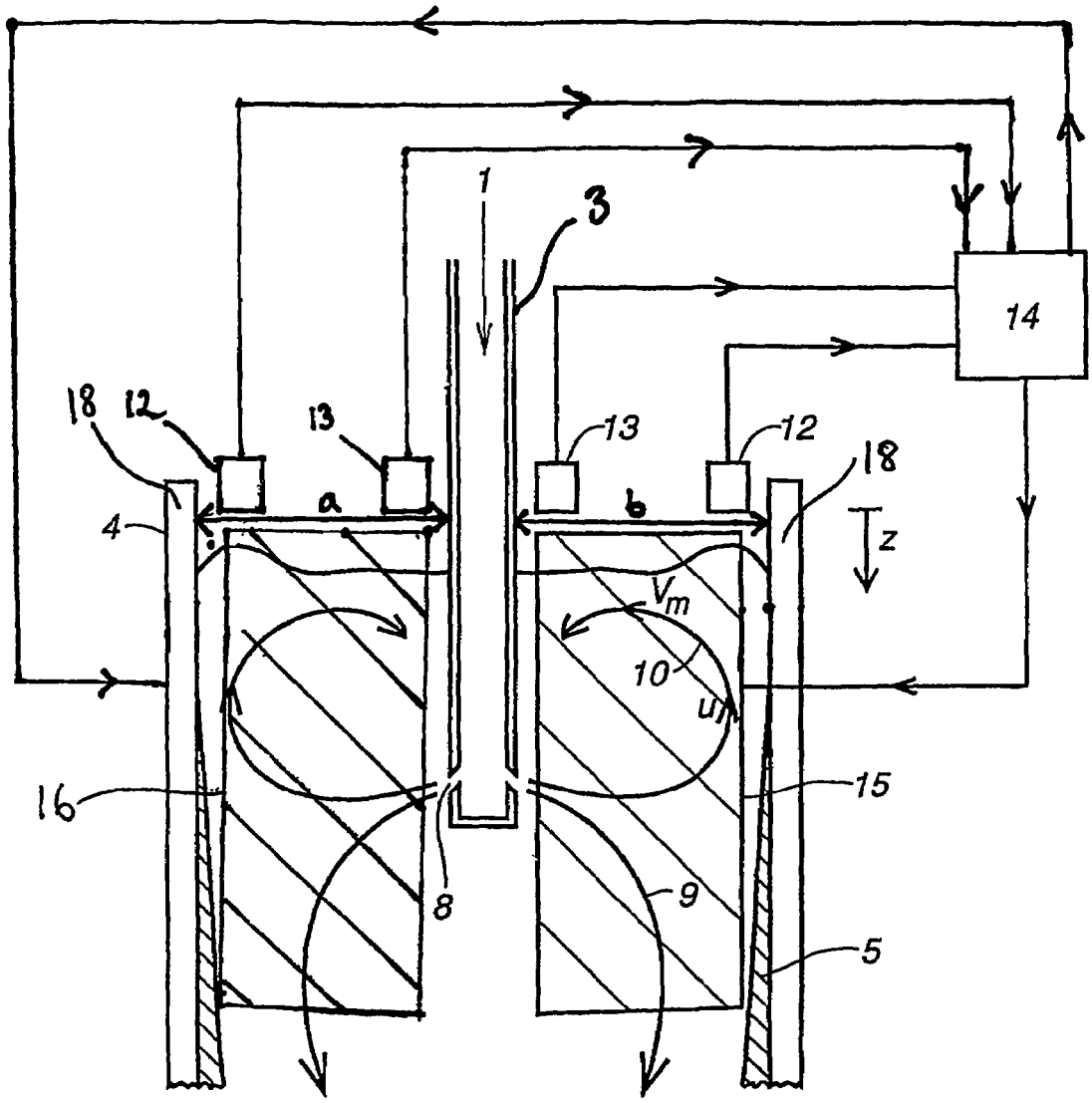
FIG. 3 shows part of a casting device depicting a control system according to a preferred embodiment of the invention where the mould is split in at least two control zones.

FIG. 2 shows that the sensors are arranged in one half of the mould. However the undulations of the meniscus are never completely symmetrical due to blockages of the ports of the nozzle by the adhesion of inclusions or their sudden unblocking when these inclusions become dislodged for example. It is therefore advantageous to divide the mould into a number of zones as shown in FIG. 3, of any shape or size, each comprising at least one sensor that provides information to a control system that regulates electromagnetic means acting only within that zone independently of the electromagnetic means influencing the other zones of the mould. In addition to regulating the electromagnetic means, when the control device 14 has detected an unsymmetrical flow, also called biased flow, the characteristic of the meniscus may be controlled. In a rectangular mould, comprising two long side walls (not shown) and two short side walls 18, the sensors are preferably arranged between the submerged entry nozzle and a short side of the mould. By regulating the distance a,b extending between at least one short side wall of the mould 4 and the submerged entry nozzle 3. The regulation of this distance a,b may be achieved by moving at least one of the short side walls of the mould. Preferably both of the short side walls are moved at the same time, so that the slab width is maintained. Another way of regulating the distance a,b between the submerged entry nozzle 3 and the short side walls is to move the submerged entry nozzle parallel to the wide side wall of the mould such that a symmetrical flow is achieved in the two control zones 15,16. Yet another way of achieving a symmetrical flow in the two control zones 15,16 of the mould is to vary the angle of the submerged entry nozzle 3 in relation to the casting direction (z).

Figure 4:
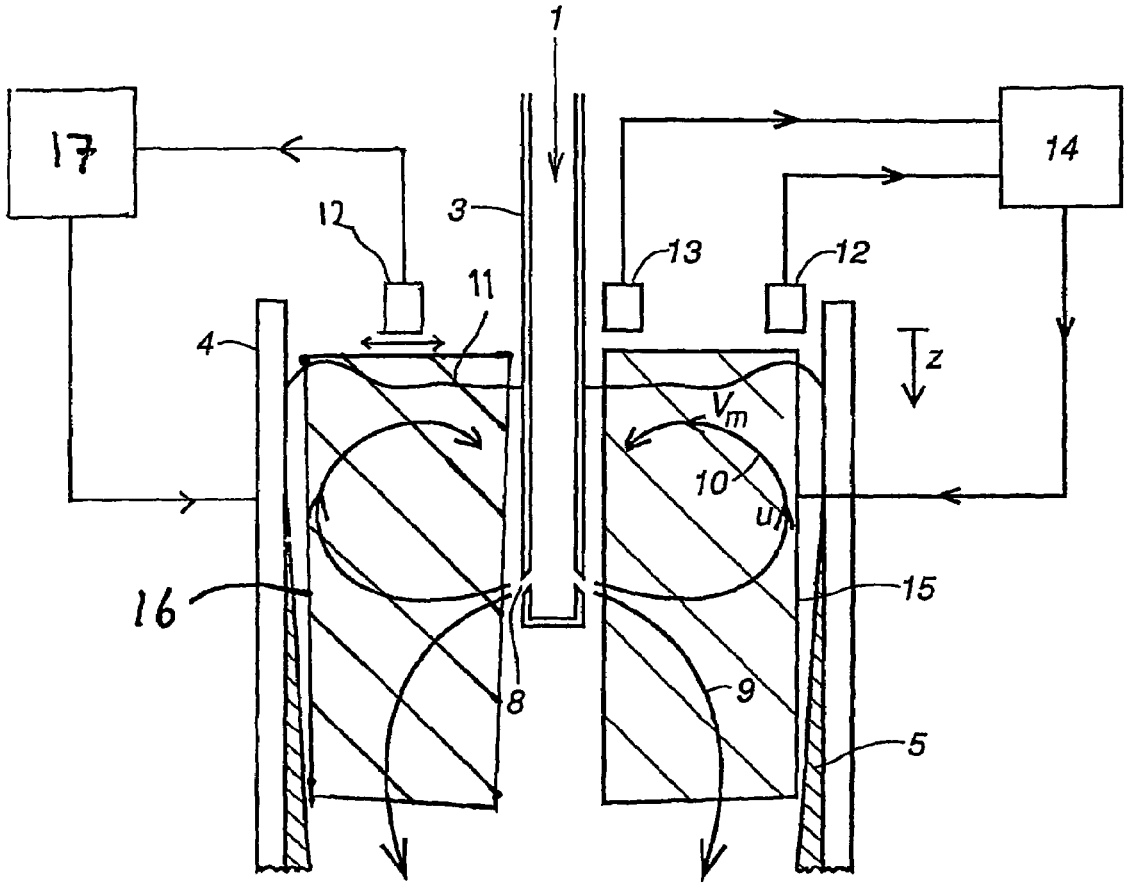
FIG. 4 shows part of a casting device depicting a control system according to an embodiment of the invention where at least one detector is arranged to be movable

When the mould is split into two or more control zones 15,16 as shown in FIG. 4, the electromagnetic means may be divided into a number of parts corresponding to the number of control zones 15,16 in the mould 4. When an unsymmetrical characteristic of the meniscus 3 for the control zones 15,16 is detected, the magnetic field from at least one part of the electromagnetic means is varied in order to influence the flow in its corresponding control zone and to achieve a symmetrical flow in the mould. Each control zone includes a control unit 14, 17.

As shown in FIG. 3, the control system may comprise only one sensor 12 instead of two sensors 12,13, arranged to be movable over the meniscus 11. The sensor 12 scans over the meniscus and measures the height at at least two points on the meniscus. The height difference between two points on the meniscus is used to derive the flow velocity of molten metal at the meniscus ($v_m$). Instead of measuring flow velocity, the sensors may measure the temperature at at least two points on the meniscus.

While only certain preferred features of the present invention have been illustrated and described, many modifications and changes will be apparent to those skilled in the art. It is therefore to be understood that all such modifications and changes of the present invention fall within the scope of the claims.

The invention claimed is:

1. A device for casting a metal, comprising:

a mold comprising a plurality of walls, means to supply liquid metal to the mold comprising a submerged entry nozzle, and electromagnetic means to regulate the flow of liquid metal in the mold, a control system comprising a detector operative to measure a height of a meniscus at at least two points on the meniscus instantaneously throughout a casting process, wherein a first of the at least two points is located between one of the walls of the mold and the submerged entry nozzle and a second of the at least two points is located between the first point and the submerged entry nozzle, a control unit operative to evaluate data from the detector including utilizing a difference between the height of the meniscus at the at least two points to derive a flow velocity of molten metal at the meniscus, and means to automatically vary at least one process parameter in order to optimize casting conditions, wherein said at least one process parameter is varied in order to maintain the derived flow velocity of molten metal at the meniscus within a predetermined range or at a predetermined value, and wherein said at least one process parameter comprises a casting speed, noble gas flow rate, magnetic field strength of electromagnetic means, slab width, immersion depth of the submerged entry nozzle, or angle of the submerged entry nozzle.

2. The device according to claim 1, wherein the electromagnetic means comprises an electromagnetic brake or stirring apparatus.

3. A control system for regulating the flow of liquid metal in a device for casting a metal, comprising:

a detector operative to measure a height of a meniscus at at least two points on the meniscus instantaneously throughout a casting process, wherein a first of the at least two points is located between a wall of a mold and a submerged entry nozzle and a second of the at least two points is located between the first point and the submerged entry nozzle;

a control unit operative to evaluate data from the detector including utilizing a difference between the height of the meniscus at the at least two points to derive a flow velocity of molten metal at the meniscus; and means to automatically vary at least one process parameter in order to optimize casting conditions, wherein said at least one process parameter is varied in order to maintain the derived flow velocity of molten metal at the meniscus within a predetermined range or at a predetermined value, and wherein said at least one process parameter comprises a casting speed, noble gas flow rate, magnetic field strength of electromagnetic means, slab width, immersion depth of the submerged entry nozzle, or angle of the submerged entry nozzle.

4. The control system according to claim 3, wherein said electromagnetic means comprises an electromagnetic brake or stirring apparatus.

5. The control system according to claim 3, wherein the flow velocity of molten metal at the meniscus is in the range 0.1-0.5 $ms^{-1}$.

6. The control system according to claim 3, wherein the characteristic of the meniscus that is measured is a temperature.

7. The control system according to claim 6, wherein the detector measures the temperature of the meniscus directly or indirectly.

8. The control system according to claim 3, wherein a the first of the at least two points is located in a first region where an upwardly flowing metal of a secondary flow makes impact with the meniscus and the second of the at least two points is located in a second region downstream to the first region.

9. The control system according to claim 3, wherein the detection means sample data continuously.

10. The control system according to claim 3, wherein the detection means sample data periodically.

11. The control system according to claim 10, for use in a device for casting a metal that comprises electromagnetic means or stirring apparatus to regulate the flow of liquid metal in the mold, wherein the electromagnetic means are temporarily deactivated and the detection means sample data during this period.

12. The control system according to claim 11, wherein the electromagnetic means are de-activated at a predetermined phase position of the detector so as to enable correction of a remaining remanence.

13. The control system according to claim 12, wherein the electromagnetic means provides at least one current pulse during a de-activation period in order to remove the remaining remanence after the de-activation of the electromagnetic means.

14. The control system according to claim 11, wherein the electromagnetic means comprises an electromagnetic brake.

15. The control system according to claim 10, for use in a device for casting a metal comprising a mold that comprises means to oscillate the mold, wherein the detector is synchronized with the mold oscillation so that data is sampled at the same phase position of the mold oscillation.

16. The control system according to claim 10, wherein the detector is incorporated into the electromagnetic means.

17. The control system according to claim 16, wherein the detector and the electromagnetic means utilize a same, or parts of a same, magnetic core and/or a same induction winding.

18. The control system according to claim 3, wherein at least one of the detection means is arranged to be movable across and essentially parallel to the meniscus.

19. The control system according to claim 3, further comprising:

software means to derive the flow velocity of molten metal at the meniscus using data from the detection means and determine the amount of regulation of a process parameter that is required to adjust the flow velocity of molten metal at the meniscus.

20. The control system according to claim 3, wherein the mold is split into two or more control zones arranged on opposite sides of the submerged entry nozzle, wherein a characteristic of the meniscus is measured in each control zone, and wherein the at least one process parameter is varied in order to achieve a symmetrical flow in the mold.

21. The control system according to claim 20, wherein the mold comprises two short sides and two long sides, and wherein the at least one process parameter is a distance between at least one short side wall of the mold and the submerged entry nozzle.

22. The control system according to claim 21, wherein the distance is varied by moving the submerged entry nozzle in a direction parallel and horizontal to the long side wall of the mold.

23. The control system according to claim 21, wherein the distance is varied by moving at least one of the short side walls of the mold.

24. The control system according to claim 20, wherein the electromagnetic means are divided into a number of parts corresponding to the number of control zones in the mold, and wherein, upon detection of an unsymmetrical characteristic of the meniscus for the control zones, a magnetic field from at least one part is varied in order to influence the flow in its corresponding control zone and to achieve a symmetrical flow in the mold.

25. The control system according to claim 3, wherein the flow velocity of molten metal is in the range 0.2-0.4 $ms^{-1}$.

* * * * *